US005683237A

United States Patent [19]

Hagiwara et al.

[11] Patent Number: 5,683,237

[45] Date of Patent: Nov. 4, 1997

[54] HORIZONTAL TYPE SCROLL COMPRESSOR HAVING INLET PORTS AT AN UPPER LEVEL OF THE CASING

[75] Inventors: Shigeki Hagiwara; Takekazu Obitani; Hiromichi Ueno; Shuichi Jomura, all of Osaka, Japan

[73] Assignee: Daikin Industries, Ltd., Japan

[21] Appl. No.: 591,652

[22] PCT Filed: Jun. 21, 1995

[86] PCT No.: PCT/JP95/01233

§ 371 Date: Feb. 12, 1996

§ 102(e) Date: Feb. 12, 1996

[87] PCT Pub. No.: WO96/00350

PCT Pub. Date: Jan. 4, 1996

[30] Foreign Application Priority Data

Jun. 24, 1994 [JP] Japan ..... 6-143434

[51] Int. Cl.[6] ..... F04C 18/04; F04C 23/00; F04C 29/02

[52] U.S. Cl. ..... 418/55.2; 418/55.6; 418/96

[58] Field of Search ..... 418/55.1, 55.2, 418/55.6, 96

[56] References Cited

FOREIGN PATENT DOCUMENTS

| | | | |
|---|---|---|---|
| 1-96488 | 4/1989 | Japan . | |
| 3-26889 | 2/1991 | Japan . | |
| 3-145589 | 6/1991 | Japan | 418/55.6 |
| 4-129801 | 11/1992 | Japan . | |
| 5-223066 | 8/1993 | Japan | 418/55.6 |
| 5-231356 | 9/1993 | Japan . | |
| 6-33890 | 2/1994 | Japan | 418/55.6 |
| 6-66274 | 3/1994 | Japan . | |

*Primary Examiner*—John J. Vrablik

*Attorney, Agent, or Firm*—Sixbey, Friedman, Leedom & Ferguson, P.C.; Gerald J. Ferguson, Jr.; Tim L. Brackett, Jr.

[57] ABSTRACT

In a horizontal type scroll compressor an external end of a volute (**2*b*) of a fixed scroll (2) is extended near to an external end side of a volute (3*b*) of a movable scroll (3). By the extension of the volute (2*b*), inlet ports (22, 23) opening to compression rooms (RA, RB) respectively are disposed near to each other and are located at an upper level in a closed casing (1). An inlet passage (24) is formed at the top of a housing (4) which divides the closed casing (1) into a compression element chamber (12A) and a motor chamber (12B). The opening position of an inlet pipe (11) is displaced circumferentially with respect to the inlet passage (24). The inlet passage (24) is displaced circumferentially with respect to the inlet ports (22, 23) of the compression rooms (RA, RB). The inlet passage (24) is displaced forward in a traveling direction of the movable scroll (3) with respect to the inlet ports (22, 23**).

4 Claims, 4 Drawing Sheets

HORIZONTAL TYPE SCROLL COMPRESSOR HAVING INLET PORTS AT AN UPPER LEVEL OF THE CASING

[TECHNICAL FIELD]

This invention relates to a horizontal type scroll compressor and specifically relates to a compressor in which a fixed scroll is engaged with a movable scroll and these fixed and movable scrolls each have an end plate and a volute.

[BACKGROUND ART]

As a conventional horizontal type scroll compressor used for a refrigerating apparatus or the like, there is well known a compressor as disclosed in the Japanese Patent Application Laid-Open Gazette No.6-66274.

As shown in FIG. 5, this scroll compressor is so formed that a horizontal type closed casing (C) accommodates at one side thereof a compression element (E) and at the other side a motor (M). The compression element (E) has a fixed scroll (FS) and a movable scroll (OS) each of which is so composed that a volute is formed on the front of an end plate. Both the volutes of the fixed scroll (FS) and the movable scroll (OS) are engaged with each other.

The motor (M) is connected to the end plate of the movable scroll (OS) through a driving shaft (S). The driving shaft (S) is supported at a compression element (E) side end thereof to the closed casing (C) through a first bearing housing (H) and is supported at the other end to the closed casing (C) through a second bearing housing which is not shown.

Meanwhile, the closed casing (C) is connected to an inlet pipe (J) which opens to an inner space (A) between the compression element (E) and the motor (M).

Further, the first bearing housing (H) is provided with a divider (B) made of flexible material such as rubber for separating the inlet side of the compression element (E) and the inner space (A). In addition, at the top of the first bearing housing (H), there is formed an inlet passage (D) for providing communication between the inner space (A) and the inlet side of the compression element (E).

At the back of the fixed scroll (FS), there is provided a partition (F) whereby a discharge chamber (G) is formed. A discharge port (P) opens to the discharge chamber (G). The discharge chamber (G) is communicated with a discharge pipe (K).

Compressing operation of the above scroll compressor is as follows.

When the motor (M) is first activated, the movable scroll (OS) does not rotate on but travels around the axis of the fixed scroll (FS). Thus, for example, low-pressure gas refrigerant returning from an evaporator of a refrigerating apparatus flows into the inner space (A) of the closed casing (C) through the inlet pipe (J).

The gas refrigerant flows out of the inner space (A), passes through the inlet passage (D), flows into the compression element (E) and is then compressed by the compression element (E) to turn high-pressure gas refrigerant. Thereafter, this high-pressure gas refrigerant flows out of the compression element (E), flows into the discharge chamber (G) through the discharge port (P) and is fed to a condenser through the discharge pipe (K).

Problems to be solved

In the above conventional horizontal type scroll compressor, there is a displacement of 180° between both the external ends of the volutes of the fixed scroll (FS) and the movable scroll (OS). This naturally presents a displacement of 180° between two inlet ports of compression rooms formed between the volutes of both the scrolls (FS, OS).

Accordingly, in the conventional horizontal type scroll compressor, when the inlet port of one of the compression rooms is positioned at an upper level in the horizontal type closed casing (C), the inlet port of the other compression room is located at a lower level in the closed casing (C).

Meanwhile, in a refrigerating apparatus with the above horizontal type scroll compressor, when defrosting operation is conducted in a reverse cycle by feeding discharged gas refrigerant to the evaporator or when switching is then made to normal operation so as to feed the discharged gas refrigerant to the condenser, a large amount of liquid refrigerant may return from the evaporator to the closed casing (C).

At this time, as mentioned above, since one inlet port is located at the lower level in the closed casing (C), a pass of liquid refrigerant through the inlet passage (D) causes the liquid refrigerant to be suctioned from the inlet port to the compression room. As a result, liquid compression occurs thereby inviting defects such as a breakage of the volute in the compressor.

Further, when the compressor is activated after its long-time deactivation, a solution of lubricating oil and refrigerant may cause foaming due to liquid refrigerant accumulating in an oil reservoir (Q) located at the bottom of the closed casing (C). When foam of the solution passes through the inlet passage (D) by the foaming, it is suctioned into the compression room. As a result, liquid compression occurs due to the solution of lubricating oil and refrigerant.

To cope with the above problems, it can be considered to position each of the inlet ports at a vertically intermediate level in the closed casing (C). Thus, the inlet port which had been located at the lower level of the closed casing (C) can be positioned up to the intermediate level.

Through the above manner, liquid compression can be slightly prevented. However, liquid refrigerant having passed through the inlet passage (D) is suctioned directly into both the inlet ports from the inlet passage (D) so that liquid compression cannot sufficiently be prevented.

This invention has been made in view of the foregoing problems. It is an object of this invention to prevent liquid compression even if liquid refrigerant accumulates and a large amount of liquid refrigerant returns, thereby eliminating, with a simple structure, troubles such as defects in activation due to liquid compression and the breakage of the volute.

[DISCLOSURE OF INVENTION]

To attain the above object, in a measure taken in the invention, a compression element (E) is accommodated at a side area of a horizontal type closed casing (1) and a motor (M) is accommodated at another side area of the closed casing (1).

The compression element (E) has a fixed scroll (2) and a movable scroll (3) each of which is so composed that a volute (*2b*, *3b*) is formed on the front of an end plate (*2a*, *3a*). The compression element (E) is so composed that both the volutes (*2b*, *3b*) of the fixed scroll (2) and the movable scroll (3) are engaged with each other. Between both the scrolls (2, 3), a plurality of compression rooms (RA, RB) are formed in pairs.

The motor (M) is connected to the movable scroll (3) so as to travel it around the axis of the fixed scroll (2). Further, there is premised a horizontal type scroll compressor in which an inlet pipe (11) opens between the compression element (E) and the motor (M) in an inner space (12) of the closed casing (1).

An external end of the volute (2*b*) of the fixed scroll (2) is extended near to an external end of the volute (3*b*) of the movable scroll (3) in order that inlet ports (22, 23) of the pair of compression rooms (RA, RB) are located near to each other. Both the scrolls (2, 3) are so disposed that the inlet ports (22, 23) are located at an upper level in the closed casing (1).

Further, in the inner space (12), a housing (4) for dividing the inner space (12) into a compression element chamber (12A) and a motor chamber (12B) is provided between the compression element (E) and the motor (M). The inlet pipe (11) opens to the motor chamber (12B).

In addition, an inlet passage (24) communicating with an inlet part to which the inlet ports (22, 23) open is formed at the top of the housing (4) and the housing (4) is provided with an oil backing passage (25) which communicates with the compression element chamber (12A) and the motor chamber (12B) and has a set flow resistance.

A measure taken in the invention is so composed that the position that the inlet pipe (11) opens to the motor chamber (12B) is displaced circumferentially with respect to the inlet passage (24) located at the top of the housing (4).

A measure taken is so composed that the inlet passage (24) is formed at the position displaced circumferentially with respect to the inlet ports (22, 23) of the pair of compression chambers (RA, RB).

A measure taken in the invention is so composed that the inlet passage (24) is formed at the position displaced forward in a travelling direction of the movable scroll (3) with respect to the inlet ports (22, 23).

Operations

Under the above structure, the external end of the volute (2*b*) of the fixed scroll (2) is extended so that this volute (2*b*) and the volute (3*b*) of the movable scroll (3) are asymmetric. The inlet ports (22, 23) of the pair of compression chambers (RA, RB) are positioned near to each other and are disposed at the upper level in the closed casing (1). Further, the housing (4) separates the compression element chamber (12A) to which the inlet ports (22,23) open and the motor chamber (12B) to which the inlet pipe (11) opens. The housing (4) is provided at the top with the inlet passage (24) and is provided with the oil backing passage (25).

For example, in a refrigerating apparatus, when defrosting operation is conducted in a reverse cycle or when the defrosting operation is then switched back to normal operation, a large amount of liquid refrigerant may return to the closed casing (1) through the inlet pipe (11) so that the liquid refrigerant may enter the compression element chamber (12A). Further, a solution of lubricating oil and refrigerant may foam at the time of activation so that foam of the solution may enter the compression element chamber (12A) through the inlet passage (24).

In these cases, since respective inlet ports (22, 23) of the compression rooms (RA, RB) are located at the upper level in the housing (4), liquid refrigerant or the solution cannot be suctioned into the compression rooms (RA, RB) through the inlet ports (22, 23) thereby preventing liquid compression.

Further, since oil backing from the compression element chamber (12A) to the motor chamber (12B) is securely done, oil stirring by the movable scroll (3) can be prevented.

Furthermore, since the volutes (2*b*, 3*b*) of both the scrolls (2, 3) are asymmetric, the outer diameter of the scroll (outer diameter of the end plate) can be reduced. This prevents liquid compression to enhance reliability while realizing size reduction.

In one aspect of the invention, the opening position of the inlet pipe (11) is displaced circumferentially with respect to the inlet passage (24). Accordingly, even in the case that a large amount of liquid refrigerant returns from the inlet pipe (11), the liquid refrigerant cannot be suctioned directly into the inlet passage (24) from the inlet pipe (11). As a result, liquid compression can be surely avoided thereby obtaining enhanced reliability.

In one aspect of the invention, the inlet passage (24) is displaced circumferentially with respect to the inlet ports (22, 23). Accordingly, when liquid refrigerant enters the inlet passage (24), scattering liquid refrigerant can be prevented from being suctioned directly into the inlet ports (22, 23). As a result, there can be prevented liquid compression resulting from that the liquid refrigerant scattering from the inlet passage (24) is suctioned into the inlet ports (22, 23), so that the liquid compression can be securely eliminated.

In one aspect of the invention, the inlet passage (24) is displaced forward in the traveling direction of the movable scroll (3) with respect to the inlet ports (22, 23), that is, near to the back of the external end of the volute (3*b*). Thus, in the case that liquid refrigerant scatters from the inlet passage (24) to enter the compression element chamber (12A) and is suctioned into the inlet ports (22, 23), the liquid refrigerant is required to go around the external end of the volute (3*b*). As a result, the suction can be prevented more effectively so that the effect of preventing liquid compression can be further enhanced.

Effects

The external end of the volute (2*b*) of the fixed scroll (2) are extended, the inlet ports (22, 23) of the compression rooms (RA, RB) are positioned near to each other and disposed at the upper level in the closed casing (1), and the inlet passage (24) is provided at the top of the housing (4) separating the compression element chamber (12A) to which the inlet ports (22, 23) open and the motor chamber (12B) to which the inlet pipe (11) opens. Thus, liquid compression can be securely prevented.

In detail, when a refrigerating apparatus makes defrosting operation in a reverse cycle or when then returning to normal operation, a large amount of liquid refrigerant may return to the closed casing (1) through the inlet pipe (11) so that liquid refrigerant may enter the compression element chamber (12A). Further, when the refrigerating apparatus is activated, a solution of lubricating oil and refrigerant may foam so that foam of the solution may enter the compression element chamber (12A) through the inlet passage (24). Even in these cases, since the inlet ports (22, 23) of the compression rooms (RA, RB) are located at the upper level in the closed casing (1), foam and liquid refrigerant can be prevented from being suctioned from the inlet ports (22, 23) into the compression rooms (RA, RB), thereby securely preventing liquid compression.

Further, since the oil backing passage (25) is provided in the housing (4), oil backing from the compression element chamber (12A) to the motor chamber (12B) can be securely made so that oil stirring by the movable scroll (3) can be securely prevented.

Furthermore, since the volute (2*b*) of the fixed scroll (2) and the volute (3*b*) of the movable scroll (3) are formed asymmetrically, the outer diameter of the scroll (outer diameter of the end plate) can be reduced. Accordingly, size reduction can be accomplished as well as liquid compression can be prevented thereby enhancing reliability.

The opening position of the inlet pipe (11) is displaced circumferentially with respect to the inlet passage (24). Accordingly, even in the case that a large amount of liquid refrigerant returns through the inlet pipe (11), the liquid refrigerant can be prevented from being suctioned directly into the inlet passage (24) from the inlet pipe (11). As a result, liquid compression can be surely avoided thereby obtaining enhanced reliability.

In one embodiment the inlet passage (24) is displaced circumferentially with respect to the inlet ports (22, 28). Accordingly, when liquid refrigerant enters the inlet passage (24), scattering liquid refrigerant can be prevented from being suctioned directly into the inlet ports (22, 23). As a result, there can be prevented liquid compression resulting from that the liquid refrigerant scattering from the inlet passage (24) is suctioned into the inlet ports (22, 23), so that liquid compression can be eliminated further securely.

In another embodiment, since the inlet passage (24) is displaced forward in the traveling direction of the movable scroll (3) with respect to the inlet ports (22, 28), the inlet ports (22, 23) are located near to the back of the external end of the volute (3*b*) of the movable scroll (8). Thus, in the case that liquid refrigerant scatters from the inlet passage (24) to enter the compression element chamber (12A) and is suctioned into the inlet ports (22, 23), it becomes possible that the liquid refrigerant goes around the external end of the volute (3*b*). As a result, the suction can be prevented more effectively so that the effect of preventing liquid compression can be further enhanced.

[BEST MODE FOR CARRYING OUT THE INVENTION]

Below, description is made about embodiments of the present invention with reference to the drawings.

Structure of compressor

Figure 2:
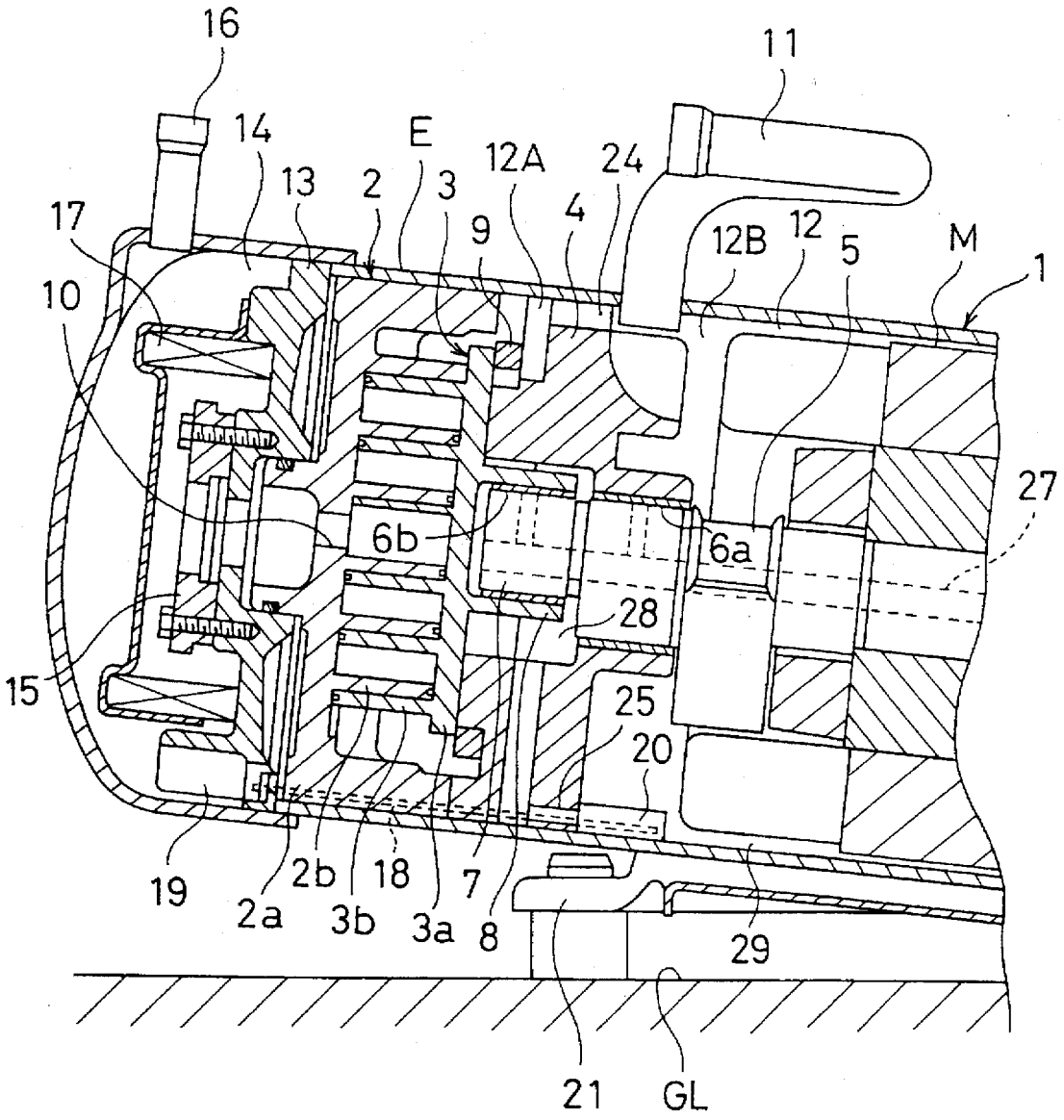
FIG. 2 is a vertical section of a horizontal type scroll compressor which is partially omitted.

As shown in FIG. 2, a horizontal type scroll compressor is provided on a refrigerant circuit of a refrigerating apparatus, and is so composed that a compression element (E) is accommodated at a side area of a closed casing (1) set in an oblong form and a motor (M) is accommodated at another side area thereof.

The compression element (E) is composed of: a fixed scroll (2) in which a volute (2*b*) is formed on the front of an end plate (2*a*); and a movable scroll (3) in which a volute (3*b*) is formed on the front of an end plate (3*a*). The volute (2*b*) of the fixed scroll (2) and the volute (3*b*) of the movable scroll (3) are engaged with each other.

The motor (M) is connected to a driving shaft (5). The driving shaft (5) is connected to the movable scroll (3) so as to travel the movable scroll (3) around the axis of the fixed scroll (2).

One end of the driving shaft (5) is disposed near to the compression element (E) and is supported via a bearing (6*a*) to the housing (4) fixed to the closed casing (1). The other end is supported to the closed casing (1) via an unshown bearing housing.

A decentered shaft part (7) is formed at one end of the driving shaft (5). The decentered shaft (7) is inserted through a bearing (6*b*) into a cylindrical shaft member (8) projecting from the back of the end plate (3*a*) of the movable scroll (3).

Further, an Oldham ring (9) for preventing the movable scroll (3) from rotating on the axis of the fixed scroll (2) is provided between the end plate (3*a*) of the movable scroll (3) and the housing (4).

When the motor (M) is activated to rotate the driving shaft (5), the movable scroll (3) does not rotate on but travels around the axis of the fixed scroll (2). This travel of the movable scroll (3) brings about a first compression room (RA) and a second compression room (RB) between both the volutes (2*b*, 3*b*). Reduction in volume of both the compression rooms (RA, RB) causes the compression of refrigerant. The compressed refrigerant is discharged from a discharge port (10) formed at the center of the end plate (2*a*) of the fixed scroll (2).

Meanwhile, an inlet pipe (11) for leading refrigerant is opened between the compression element (E) and the motor (M) in an inner space (12) of the closed casing (1).

Further, on the back of the end plate (2*a*) of the fixed scroll (2), there is provided a dividing plate (13) fixed to the closed casing (1). The dividing plate (13) forms a discharge chamber (14) at the backward position of the end plate (2*a*) of the fixed scroll (2). The discharge port (11) opens to the discharge chamber (14) through a discharge valve device (15) provided on the dividing plate (13). The discharge chamber (14) is communicated with a discharge pipe (16).

Furthermore, the dividing plate (13) is provided with a demister (17) for capturing lubricating oil. The lubricating oil in the discharge chamber (14) is recovered to the motor chamber (12B) by a capillary (18).

In addition, the dividing plate (13) is provided integrally with a gas shield part (19). A capillary guide plate (20) is provided at the end of the capillary (18). The closed casing (1) is supported to a mounting foot (21) so as to lean with respect to a mounting surface (GL).

Figure 1:
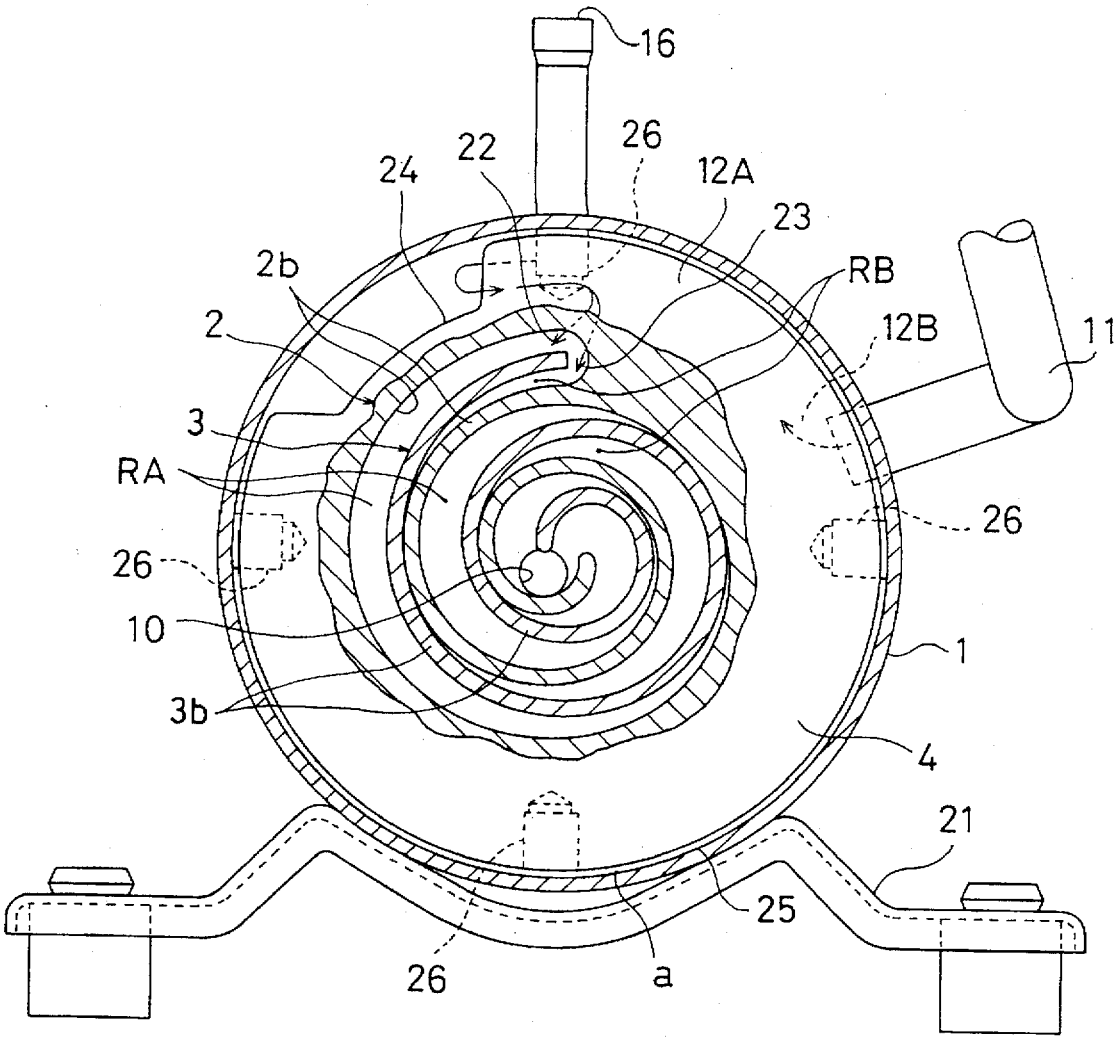
FIG. 1 which shows an embodiment of the present invention is a cross sectional view of a housing in which respective volutes of a fixed scroll and a movable scroll are partially cut away.

In the above-mentioned horizontal type scroll compressor, as shown in FIG. 1, a first feature of the present invention is the volute (2*b*) of the fixed scroll (2). In detail, the external end of the volute (2*b*) of the fixed scroll (2) is extended approximately to the position opposite to the external end of the volute (3*b*) of the movable scroll (3).

The extension of the volute (3*b*) causes the inlet ports (22, 23) of the two compression rooms (RA, RB) formed between both the scrolls (2, 3) to be located near to each other. Further, as shown in FIG. 1, both the scrolls (2, 3) are so disposed that the inlet ports (22, 23) are located at the upper level in the closed casing (1).

The housing (4) provided between the compression element (E) and the motor (M) divides the inner space (12) into the compression element chamber (12A) to which the inlet ports (22, 23) open and the motor chamber (12B) to which the inlet pipe (11) opens. The inlet ports (22, 23) open to an inlet part of the compression element chamber (12A). At the top of the housing (1), there is formed an inlet passage (24) communicating with the inlet part of the compression element chamber (12A). The housing (4) is provided with an oil backing passage (25) which communicates with the compression element chamber (12A) and the motor chamber (12B) and has a set flow resistance.

More specifically, an inner wall of the extended portion that the external end of the volute (2*b*) of the fixed scroll (2) is extended near to the external end of the volute (3*b*) of the movable scroll (3), is formed into an involute curve or its approximation similar to the other portion.

By the extension of the volute (2*b*), a suction volume of the first compression room (RA) formed between the inner wall face of the volute (2*b*) of the fixed scroll (2) and the outer wall face of the volute (3*b*) of the movable scroll (8) is made larger than that of the second compression room (RB) formed between the outer wall face of the volute (2*b*) of the fixed scroll (2) and the inner wall face of the volute (3*b*) of the movable scroll (3).

Accordingly, the first compression room (RA) and the second compression room (RB) are different in compression ratio from each other. To cope with this, at the cut-off end of either of the volutes (2*b*, 3*b*) of the movable scroll (3) and the fixed scroll (2), there is formed an adjusting cut for adjusting both the compression rooms (RA, RB) to the same compression ratio in such a manner that a starting time of discharge in the first compression room (RA) precedes that in the second compression room (RB).

Further, as shown in FIG. 1, the outer periphery of the housing (4) is formed circularly in correspondence with the inner periphery of the closed casing (1), and the top of the housing (4) is cut away to a set range to form the inlet passage (24). Furthermore, the outer periphery of the housing (4) is so formed as to have a slight clearance (a) from the inner periphery of the closed casing (1). For example, the slight clearance (a) is set to 20 μm to 30 μm and the oil backing passage (25) is formed between the housing (4) and the closed casing (1).

Figure 3:
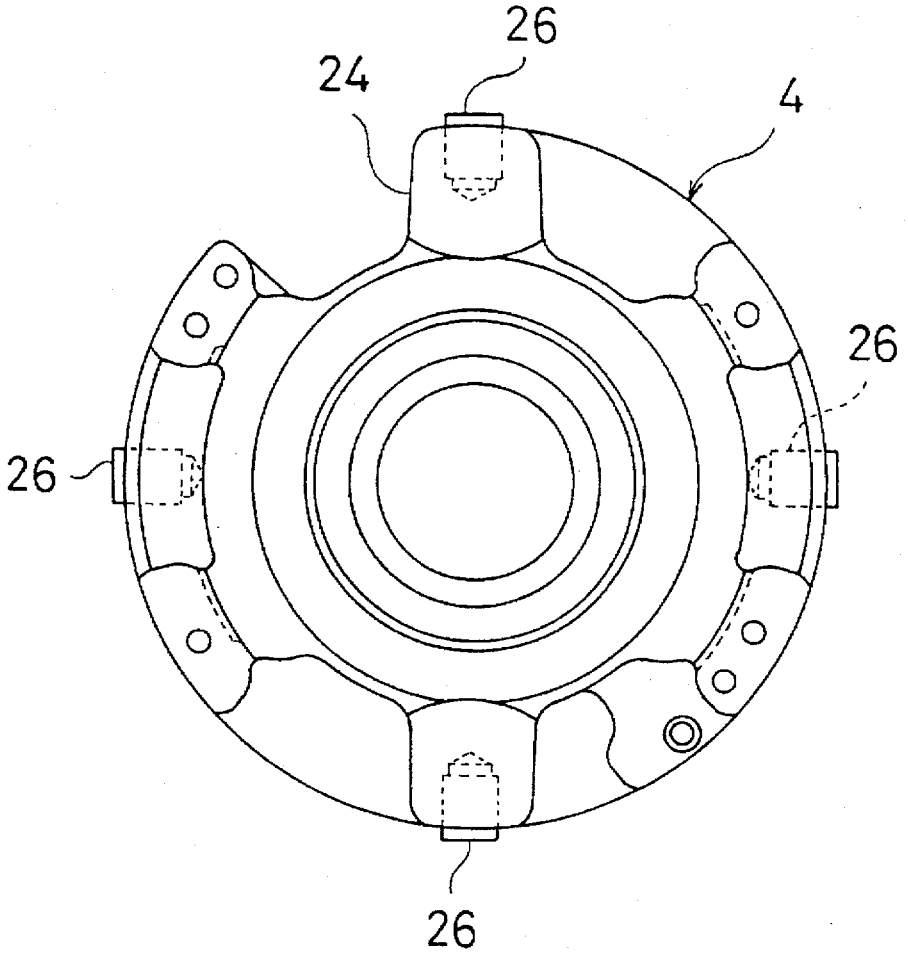
FIG. 3 is a right side view showing only the housing.

In other words, the outer diameter of the housing (4) is made slightly smaller than the inner diameter of the closed casing (1), and the housing (4) is engaged with the closed casing (1) with a space left. As shown in FIG. 3, a plurality of weld pins (26) are embedded in the outer periphery of the housing (4). In the closed casing (1), a plurality of weld holes are formed at the positions corresponding to the weld pins (26). The housing (4) is fixed, by welding, to the closed casing (1) with the slight clearance (a) left therefrom so that the slight clearance (a) forms the oil backing passage (25).

The oil backing passage (25) is a narrow passage for backing lubricating oil, which is supplied from an oil supply passage (27) formed in the driving shaft (5) to the bearings (6*a*, 6*b*) and to a thrust receiving surface supporting the end plate (3*a*) of the movable scroll (3), from the compression element chamber (12A) to the motor chamber (12B). In detail, a concavity (28) where the shaft member (8) is located is formed on the housing (4). The oil backing passage (25) is a passage for backing lubricating oil from the concavity (28) to the motor chamber (12B).

The oil backing passage (25) prevents lubricating oil and liquid refrigerant from flowing backward from an oil reservoir (29) formed at the bottom of the motor chamber (12B) as well as prevents lubricating oil from accumulating in the concavity (28) so that no oil stirring by the movable scroll (3) occurs.

In the case that the oil backing passage (25) is formed of the slight clearance (a) between the closed casing (1) and the housing (4), the housing (4) can be fixed to the closed casing (1) by welding with the weld pins (26). This provides an easy alignment of the driving shaft (5). Accordingly, this case is advantageous in that the alignment of the driving shaft (5) can readily made while the oil backing passage (25) can be formed.

Figure 4:
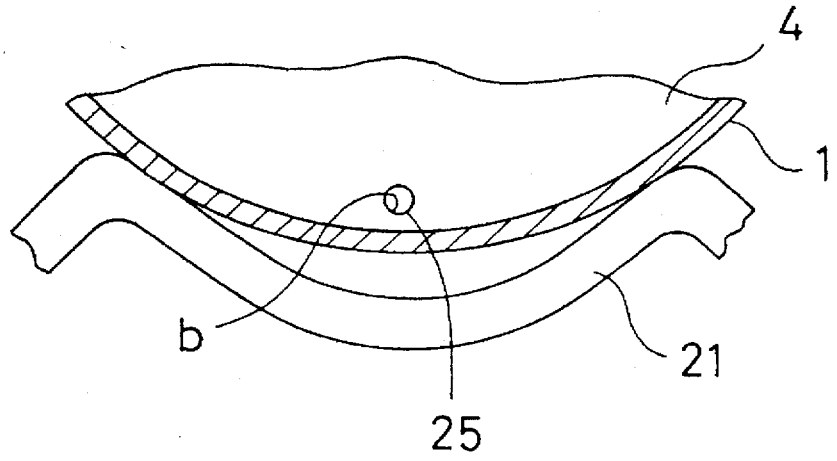
FIG. 4 is a cross section of a required part of a horizontal type scroll compressor showing another embodiment.
Figure 5:
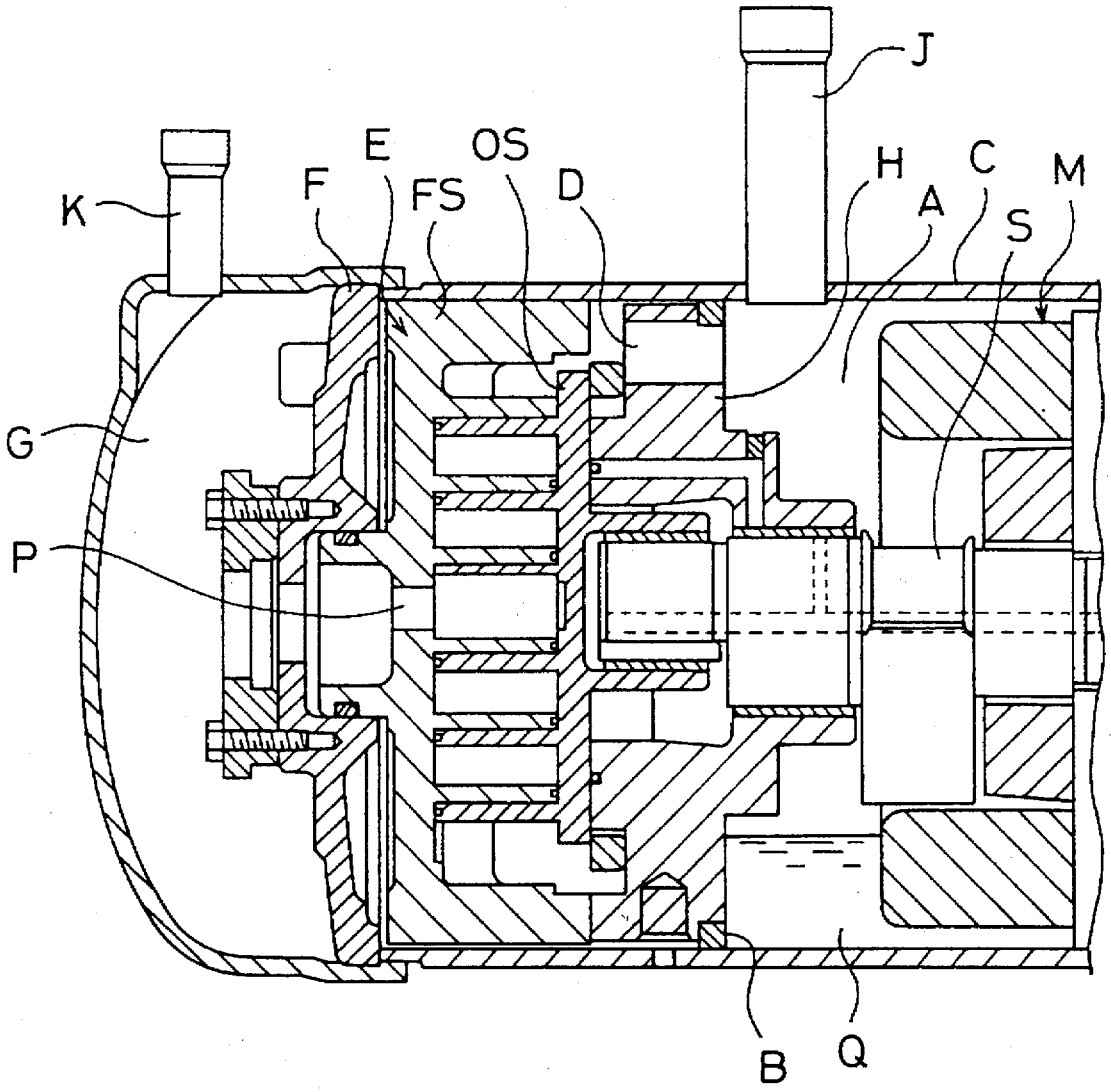
FIG. 5 PRIOR ART
FIG. 5 is a vertical section of a conventional horizontal type scroll compressor which is partially omitted.

The oil backing passage (25) may be formed, as another example, of a small communicating hole (b) as shown in FIG. 4. Further, while unshown, it may be formed of a cut or may be composed of the combination of the slight clearance (a) and the small communicating hole (b).

The inlet passage (24) can be provided at the top of the closed casing (1) in correspondence with the opening positions of the inlet ports (22, 23) disposed at the upper level in the closed casing (1). However, it is preferably displaced in a circumferential direction. More preferably, as shown in FIG. 1, the inlet passage (24) is displaced, with respect to the inlet ports (22, 23), forward in the traveling direction of the movable scroll (3) for closing the inlet ports (22, 23), that is, near to the back of the inlet ports (22, 23).

The inlet pipe (11) opens to the top of the motor chamber (12B). This opening position is preferably displaced circumferentially with respect to the inlet passage (24).

Operations of horizontal type scroll compressor

Next, description is made about operations of the above horizontal type scroll compressor.

First, when the motor (M) is activated, the movable scroll (3) does not rotate on but travels around the axis of the fixed scroll (2). Thus, low-pressure gas refrigerant returning from an evaporator of a refrigerating apparatus flows into the motor chamber (12B) of the closed casing (1) through the inlet pipe (11).

The gas refrigerant flows out of the motor chamber (12B), passes through the inlet passage (24), flows into the compression element chamber (12A), enters respective compression rooms (RA, RB) from respective inlet ports (22, 23) and is then compressed to turn high-pressure gas refrigerant. Thereafter, this high-pressure gas refrigerant flows out of the compression rooms (RA, RB), flows into the discharge chamber (14) through the discharge port (10) and is fed to a condenser through the discharge pipe (16).

As mentioned above, refrigerant flows into the compression rooms (RA, RB) from the inlet ports (22, 23), respectively. At this time, since the volutes (2*b*, 3*b*) of the fixed scroll (2) and the movable scroll (3) are asymmetric and the inlet ports (22, 23) are located near to each other and are disposed at the upper level in the closed casing (1), liquid refrigerant can be prevented from being suctioned from the inlet ports (22, 23) while size reduction can be accomplished as one of advantages of an asymmetric volute design.

In detail, when the compressor is activated, a solution of lubricating oil and refrigerant may cause foaming due to liquid refrigerant accumulating in deactivation. Further, when the refrigerating apparatus is in defrosting operation in a reverse cycle, a large amount of liquid refrigerant may return to the compressor. Furthermore, when the refrigerating apparatus returns to normal operation after that, a large amount of liquid refrigerant may return from the evaporator having fed gas refrigerant in defrosting operation to the motor chamber (12B) through the inlet pipe (11).

In these cases, foam of the solution or liquid refrigerant may be suctioned from the inlet ports (22, 23). However, as shown in FIG. 1, since both the inlet ports (22, 23) are located at the upper level in the closed casing (1), foam of the solution and liquid refrigerant can be prevented from being suctioned from the inlet ports (22, 23).

Further, the position that the inlet pipe (11) opens to the motor chamber (12*b*) is displaced circumferentially with respect to the inlet passage (24) and the inlet passage (24) is also displaced circumferentially with respect to the inlet ports (22, 23). Thus, as shown in a dotted arrow of FIG. 1, refrigerant including liquid refrigerant, which flows into the motor chamber (12B) through the inlet pipe (11), first circumferentially flows in the motor chamber (12B) along the inner periphery of the closed casing (1). Thereafter, as shown in a solid arrow, the refrigerant flows into the compression element chamber (12A) through the inlet passage (24) and then changes its flow direction to flow toward the inlet ports (22, 23).

Accordingly, on the way of refrigerant from the inlet pipe (11) to the inlet ports (22, 23) through the inlet passage (24), liquid refrigerant is separated from the refrigerant. Further, it is prevented that scattering liquid refrigerant is suctioned directly into the inlet ports (22, 23). As a result, gasified refrigerant is suctioned into the inlet ports (22, 23) so that liquid compression due to the suction of liquid refrigerant can be securely prevented.

Since lubricating oil fed to the bearings (6*a*, 6*b*) and the thrust receiving surface return to the motor chamber (12B) through the oil backing passage (25), the lubricating oil can be prevented from accumulating in the concavity (28) of the housing (4). As a result, oil stirring by the movable scroll (3) can be prevented and an amount of upward-flowing oil can be reduced. Further, liquid refrigerant or lubricating oil can be prevented from flowing backward from the oil reservoir (29).

Furthermore, since the housing (4) has a single inlet passage (24), rigidity can be ensured. This can reduce distortion on the thrust receiving surface thereby increasing the reliability of the compressor.

Other modifications

In the above embodiment, two compression rooms (RA, RB) are formed between both the scrolls (2, 3). Alternately, a plurality of compression rooms may be formed in two pairs or more. It is essential only that all the inlet ports of the compression rooms are located at the upper level in the closed casing.

Further, the above embodiment discusses as the application to refrigerating apparatus. However, it is a matter of course that the present invention can be applied to various kinds of apparatus other than refrigerating apparatus.

[INDUSTRIAL APPLICABILITY]

As described above, a horizontal type scroll compressor of this invention is useful as a compressor in refrigerant apparatus and the like, and is particularly suitable for apparatus in which liquid fluid may return.

We claim:

1. A horizontal type scroll compressor in which:

a compression element (E) is accommodated at a side area in a horizontal type closed casing (1) and a motor (M) is accommodated at another side area in the closed casing (1);

the compression element (E) has a fixed scroll (2) and a movable scroll (3) each of which is so composed that a volute (2*b*, 3*b*) is formed on the front of an end plate (2*a*, 3*a*), and is so composed that both the volutes (2*b*, 3*b*) of the fixed scroll (2) and the movable scroll (3) are engaged with each other, both the scrolls (2, 3) having therebetween a plurality of compression rooms (RA, RB) formed in pairs;

the motor (M) is connected to the movable scroll (3) so as to move the movable scroll around the axis of the fixed scroll (2); and an inlet pipe (11) opens between the compression element (E) and the motor (M) in an inner space (12) of the closed casing (1), characterized in that:

an external end of the volute (2*b*) of the fixed scroll (2) is extended near to an external end of the volute (3*b*) of the movable scroll (3) in order that inlet ports (22, 23) of the pair of compression rooms (RA, RB) are located near to each other;

both the scrolls (2, 3) are so disposed that the inlet ports (22, 23) are located at an upper level of the closed casing (1) and the inlet ports are formed for being opened and closed by the movement of the external ends of the volutes in association with the revolution of the volute (3*b*) of the movable scroll (3) so that compression begins when the inlet ports are closed;

a housing (4) for dividing the inner space (12) into a compression element chamber (12A) and a motor chamber (12B) is provided between the compression element (E) and the motor (M);

the inlet pipe (11) opens to the motor chamber (12B);

an inlet passage (24) communicating with an inlet part to which the inlet ports (22, 23) open is formed at the top of the housing (4); and the housing is provided with an oil backing passage (25) which communicates with the compression element chamber (12A) and the motor chamber (12B) and has a set flow resistance.

2. A horizontal type scroll compressor according to claim 1, wherein the position that the inlet pipe (11) opens to the motor chamber (12B) is displaced circumferentially with respect to the inlet passage (24) located at the top of the housing (4).

3. A horizontal type scroll compressor according to claim 1 or 2, wherein the inlet passage (24) is formed at the position displaced circumferentially with respect to the inlet ports (22, 23) of the pair of compression chambers (RA, RB).

4. A horizontal type scroll compressor according to claim 3, wherein the inlet passage (24) is formed at the position displaced forward in a travelling direction of the movable scroll (3) with respect to the inlet ports (22, 23).

* * * * *